US005252936A

United States Patent [19]

Norimatsu

[11] Patent Number: 5,252,936

[45] Date of Patent: Oct. 12, 1993

[54] REED RELAY AND SWITCH MATRIX DEVICE USING THE SAME

[75] Inventor: Hideyuki Norimatsu, Hachiojishi, Japan

[73] Assignee: Hewlett-Packard Company, Palo Alto, Calif.

[21] Appl. No.: 951,718

[22] Filed: Sep. 25, 1992

[30] Foreign Application Priority Data

Sep. 27, 1991 [JP] Japan ..... 3-087098[U]

[51] Int. Cl.[5] ..... H01H 1/66

[52] U.S. Cl. ..... 335/151

[58] Field of Search ..... 335/151, 152, 753, 154, 335/112; 29/622

[56] References Cited

U.S. PATENT DOCUMENTS

| | | | |
|---|---|---|---|
| 3,812,439 | 5/1974 | Parmenter | 335/151 |
| 3,958,199 | 5/1976 | Seitz, Jr. et al. | 335/154 |
| 4,243,693 | 1/1981 | Jameel et al. | 335/151 |
| 5,095,295 | 3/1992 | Hongou | 335/153 |
| 5,113,308 | 5/1992 | Takeda | 335/151 |

FOREIGN PATENT DOCUMENTS

| | | |
|---|---|---|
| 63-38518 | 10/1988 | Japan . |
| 1-20756 | 6/1989 | Japan . |

OTHER PUBLICATIONS

HP4062 U.S. Semiconductor Process Control System "System Library", Hewlett-Packard Company, Published Dec. 1988.

Norimatsu, Hideyuki, "High Speed Measurement of FET Vth at Low Id," Proc. IEEE 1989 Int. Conference on Microelectronic Test Structures, vol. 2, No. 1, Mar. 1989.

HP 4062C/UX Semiconductor Test System (product Note 4062-1), Hewlett-Packard Company, Printed Jul. 1990.

*Primary Examiner*—Lincoln Donovan

[57] ABSTRACT

A switching operation for connection between plural measuring devices and plural DUTs is easily performed with a matrix of reed relays and connecting switches. The reed relay has a first guard pipe provided so as to cover a region extending from one end of the reed switch to the position adjacent to the contact point. A second guard pipe is provided so as to cover a region extending from the other end of the reed switch to a portion where the first guard pipe starts. When the reed relay is closed, and the first and second guard pipes are kept at the same potential as the signal line of the reed relay. On the other hand, when the reed relay is open, the guard connecting switch is also open. In this open switch case, the voltage at both terminals of the reed relay is ordinarily different. The signal lines of the reed switch at the measuring device side and the DUT side are respectively guarded by the first and second guard pipes.

4 Claims, 6 Drawing Sheets

REED RELAY AND SWITCH MATRIX DEVICE USING THE SAME

FIELD OF THE INVENTION

This invention relates to a reed relay and a switch matrix device using the same, and particularly to a reed relay and a switch matrix device using the same in which a connection-switching operation between a measuring device and a device under test (DUT) can be simply performed with high accuracy.

BACKGROUND OF THE INVENTION

A reed relay and a switch matrix device using such reed relays have been conventionally utilized to measure an electrical characteristic of one or more devices under test (DUT) by suitably switching the connections between plural measuring devices and plural devices under test (DUTs).

FIG. 1 is a partial view of an example of a measuring device using the matrix device as described above. This device includes a reed relay matrix $rr_{jk}$ (j, k=1, 2, 3) provided at each lattice point of the matrix. The matrix comprises signal lines 21 through 23 arranged in a lateral direction and signal lines 24 through 26 arranged in a longitudinal direction. In this device, a voltage of a D.C. power source 1 is applied to the DUT 2 by selecting a suitable combination of on-and-off states of the reed relays $rr_{jk}$ at the respective lattice points. In FIG. 1, only $rr_{12}$ and $rr_{21}$ are selectively switched on. A current flowing through a DUT 2 is measured by an ammeter 3 to analyze an electrical characteristic of the DUT 2.

In such a measuring device, a very small amount of current would be measured by the ammeter 3 if the DUT 2 had a high resistance. When a coaxial cable with grounded outer conductor is used for signal lines 21 through 26, the effect of an external electromagnetic field and a mutual electromagnetic field are substantially eliminated. However, because a potential difference occurs between the central conductor and the outer conductor, there occurs a problem that a leak current unfavorably flows through the insulating material between the central conductor (signal line) and the outer conductor of the coaxial cable.

As shown in FIG. 2, a conventional reed relay comprises a reed switch 11 which has both ends connected to the signal lines, a conductive cylindrical member (guard pipe) 13 which is disposed so as to cover the reed switch 11 over an insulating material 12 and a driving coil 14 which is wound around the peripheral surface of the guard pipe 13. The reed relay of such construction also has the same problem as the coaxial cable. That is, a detrimental leak current flows through the insulating material 12 between the signal lines of the reed switch 11 and the guard pipe 13, if the guard pipe 13 is grounded to eliminate the effect of the external electromagnetic field.

The leak current occurring in the coaxial cable can be prevented by equalizing the potential of the outer conductor with the central conductor. By connecting the outer conductor to a guard terminal, the potentials are kept at the same as the central conductor. Likewise,the leak current occurring in the reed relay can be prevented by equalizing the potentials of the signal line and the guard pipe 13 of each reed relay. For this purpose, lines constituting the grid of the switch matrix are classified into two groups; one is a signal line group, and the other is a guard line group for connecting the guard terminals to the guard pipes 13.

FIG. 3 is a partial view of a measuring circuit with the switch matrix device comprising the two line groups as described above. In FIG. 3, a D.C. power source 1 is connected through an ammeter 3 to a signal line 31 (shown in a lateral direction) and a guard line 32 (shown in the lateral direction). The signal line 31 can be connected to each of signal lines 33, 35 and 37 through the corresponding reed relays $rr_{11}$, $rr_{12}$ and $rr_{13}$ as shown in FIG. 3. Guard line 32 is connected to guard pipe 13 as shown in FIG. 2 (not shown in FIG. 3) of each of the reed relays, and it can also be connected to each of guard lines 34, 36 and 38 through corresponding connecting switches $sw_{11}$, $sw_{12}$ or $sw_{13}$. In FIG. 3, a current measurement of the DUT 2 is performed by closing only reed relay $rr_{13}$, as shown. The leak current is prevented by closing only switch $sw_{13}$.

The guard pipe 13 of each reed relay is ordinarily connected to the side of the relay which is closer to the D.C. power source 1 and the ammeter 3. That is, it is connected to the measuring device side. When an ordinary relay without a guard pipe 13 is used as the switch, a leak current possibly occurs in the switch. Although a circuit construction for preventing the leak current from affecting the measuring system can be designed by selecting a suitable combination of on-and-off states of the reed relays and the switches, the matrix device as shown in FIG. 3 has disadvantages because of connection of the matrix connection, as will be discussed in connection with FIGS. 4 and 5.

In FIG. 4, it is assumed that the reed relays $rr_{11}$ and $rr_{12}$ are respectively switched on and off and, at the same time the switches $sw_{11}$ and $sw_{12}$ are correspondingly switched on and off for measurement of a resistance value of the DUT 2. This arrangement provides opportunities to test a DUT under two different voltage sources or measuring devices. The guard pipe 13 of the reed relay $rr_{12}$ does not contribute to the measurement of the DUT 2. The guard pipe 13 is connected to a guard line of a D.C. power source 1' which does not contribute to the measurement of the DUT 2. The guard line is kept at a ground potential. A leak current as indicated by an arrow in FIG. 4 still unfavorably occurs even if the relay $rr_{12}$ and switch $sw_{12}$ are open. This is because a potential difference exists between the signal line **43*b* of the reed relay $rr_{12}$ at the side of the DUT 2 and the guard pipe 13 of the reed relay $rr_{12}$. But the arrangement of FIG. 4 is entirely different from that of FIG. 3**.

In order to overcome the problem, there has been conventionally proposed a technique as shown in FIG. 5. The relays $rr_{11}$ and $rr_{12}$ are respectively connected in series to new relays $rr'_{11}$ and $rr'_{12}$ to reduce the leak current. In this technique, respective guide pipes 13 of the added reed relays $rr'_{11}$ and $rr'_{12}$ are respectively connected to the guard lines **42*b* and 44*b***. The measuring system leak current as indicated by a dotted line hardly flows in its current passageway because the switch $sw_{12}$ is open. Therefore, occurrence of a measurement error due to the leak current is substantially eliminated.

The device as shown in FIG. 5 has the following disadvantage of doubling the number of reed relays. Since the number of parts in the device is increased and the circuit construction is more complicated, the manufacturing cost is increased. At the same time, the reliability of the device is also reduced.

This invention as designed overcomes the above problem. Thus, an object of the invention is to provide an improved reed relay having a high guard effect, in which switching operations for connection between measuring devices and DUTs can be easily performed with a simple circuit construction. Another object is to provide a switch matrix device using the improved reed relay.

SUMMARY OF THE INVENTION

The reed relay according to this invention has a reed switch having a contact point therein, a first guard pipe which is provided so as to cover a first region extending from one end of the reed switch to a position adjacent to the contact point of the reed switch, and a second guard pipe which is insulated from the first guard pipe and is provided at the outside of the first guard pipe so as to cover a second region extending from the other end of the reed switch to at least one end of the first region.

Further, the reed relay in combination with a switch matrix device according to this invention comprises a guard connecting switch for switching a connection between measuring devices and DUTs. The guard connecting switch has one end connected to the first guard pipe and the other end connected to the second guard pipe.

According to the reed relay of this invention with the contact point of the reed switch at the center of the reed relay, the one side of the reed relay is covered or coated by the first guard pipe while the other side of the reed relay is covered or coated by the second guard pipe. The second guard pipe is disposed outside the first guard pipe. At the overlapped portion of the first and second guard pipes, a guard effect of the first guard pipe has priority over that of the second guard pipe because the first guard pipe is disposed inside the second guard pipe at the overlapped portion. Therefore, the second guard pipe may be designed to cover the first guard pipe. However, if a portion of the reed relay were not coated by either the first or second guard pipes, unfavorable electrostatic capacitance would occur between the signal lines and conductor portions other than the guard pipes such as a driving coil. Therefore, the reed switch is required to be coated by either of the first or second guard pipes.

According to the switch matrix device of this invention, the on/off state of the guard connecting switch is determined by that of the reed relay. When the reed relay is closed, the guard connecting switch is also closed, and thus the first and second guard pipes are kept at the same potential. The circuit construction is so designed that the potential of the first and second guard pipes are equal to that of the signal line of the reed relay. With this construction, the signal line is provided with the guard effect.

On the other hand, when the reed relay is open, the guard connecting switch is also open. In this case, the voltages at both the ends of the reed relay are ordinarily different with each other. Thus, the circuit construction is preferably designed such that the potential of each guard pipe is equal to the potential of each terminal of the reed switch (the potential of a signal line at the measuring device and DUT side) for providing the guard effect. However, as is apparent from the description of the embodiment as described later, the effect of this invention would be obtained even if the potentials of the guard pipe and each terminal of the reed switch are different from each other.

In most cases, the leak current flows through the surface of an insulating material of the reed relay. According to the reed relay of this invention, the circuit construction can be easily designed such that the surface of the insulating material exists only between the signal line and each guard pipe or between the first and second guard pipes. If the circuit construction is designed such that one end of the signal line and the first guard pipe are overlapped on one side of the reed relay while the other side of the signal line and the second guard pipe are overlapped on the other side of the reed relay, the occurrence of the leak current which would flow through the surface of the insulting material is substantially eliminated to improve the measuring accuracy.

There are many cases where the leak current between the guard pipes has no effect on the measuring system. Thus, there is little measurement error due to the leak current. In association with the improvement of the measurement accuracy which is achieved by preventing the leak current, a reed relay and a switch matrix device which have remarkably higher performance than conventional ones are implemented.

DETAILED DESCRIPTION OF THE PREFERRED EMBODIMENTS

Figure 6:
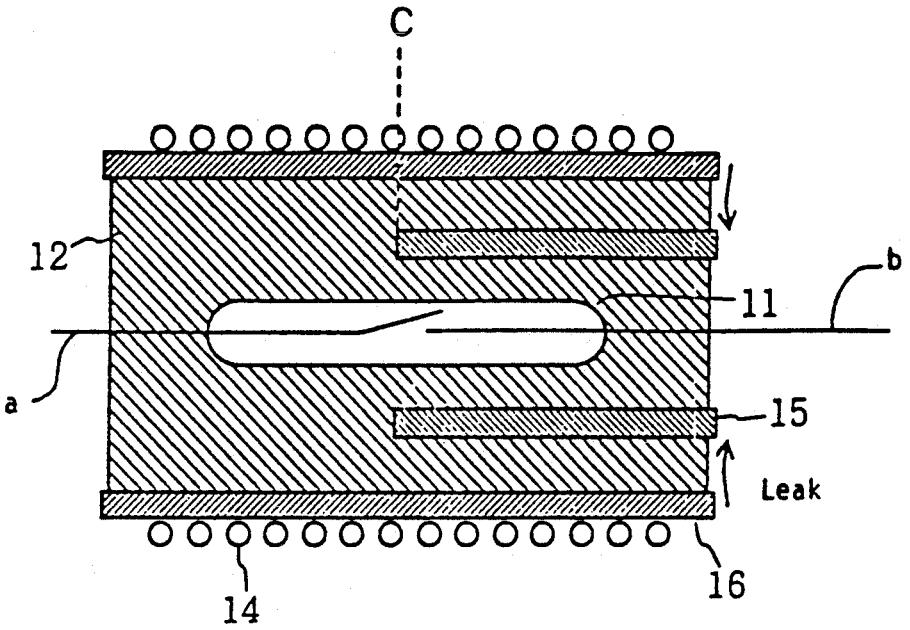
FIG. 6 is a sectional view of an embodiment of the reed relay of the current invention.

FIG. 6 is a sectional view taken in an axial direction of an embodiment of the reed relay according to this invention. The reed switch 11 has the same construction as a conventional switch and comprises an insulating material 12, and a pair of lead pieces a and b of ferromagnetic material disposed in the insulating material 12 in such a manner as to be confronted with each other at an internal void. The lead pieces a and b constitute terminals for connecting the signal lines at the outside of the insulating material 12. A first guard pipe 15 is provided around the reed switch 11 in such a manner as to extend from one end portion of the reed relay (as indicated by the terminal b side in FIG. 6) to a position c proximate with the contact point of the reed switch 11. A second guard pipe 16 is also provided outside the first guard pipe 15 and covers the entire length of the insulting material 12 as shown in FIG. 6. An insulating material 12 which is similar to that used for an ordinary reed relay is filed into a space defined by the two second guard pipes 16. A driving coil 14 which is also similar to one used for the ordinary reed relay is provided outside the second guard pipe 16.

In an alternative embodiment, the second guard pipe 16, (1) may be provided in such a manner as to extend to the one end of the first guard pipe 15 at the terminal b side as shown in FIG. 6, or (2) may be provided in such a manner as to extend from the other end of the reed relay (the a end) to at least point c of the first guard pipe 15 (at the contact point). As the overlapped area between the first guard pipe 15 and the second guard pipe 16 increases, the leak current due to a potential difference between the guard pipes 15 and 16 also increases. The overlapped area is maximum in the case (1). However, actually, the overlap between the first and second guard pipes 15 and 16 has no unfavorable effect because the leak current flows through the surface of the insulating material 12. If an uncoated portion which is not covered by either of the first or second guard pipes existed in the reed switch 11, electrostatic capacitance would occur between the conductor constituting the signal line of the reed switch 11 and conductors such as the driving coil 14. This electrostatic capacitance would likewise cause a measurement error. Therefore, the reed switch 11 should be coated at least by either the first pipe 15 or second guard pipe 16.

Even if a leak current occurs between the first and second guard pipes 15 and 16, this leak current ordinarily has no effect on the measuring system, as will be described later, such that no significant measurement error occurs.

Figure 7:
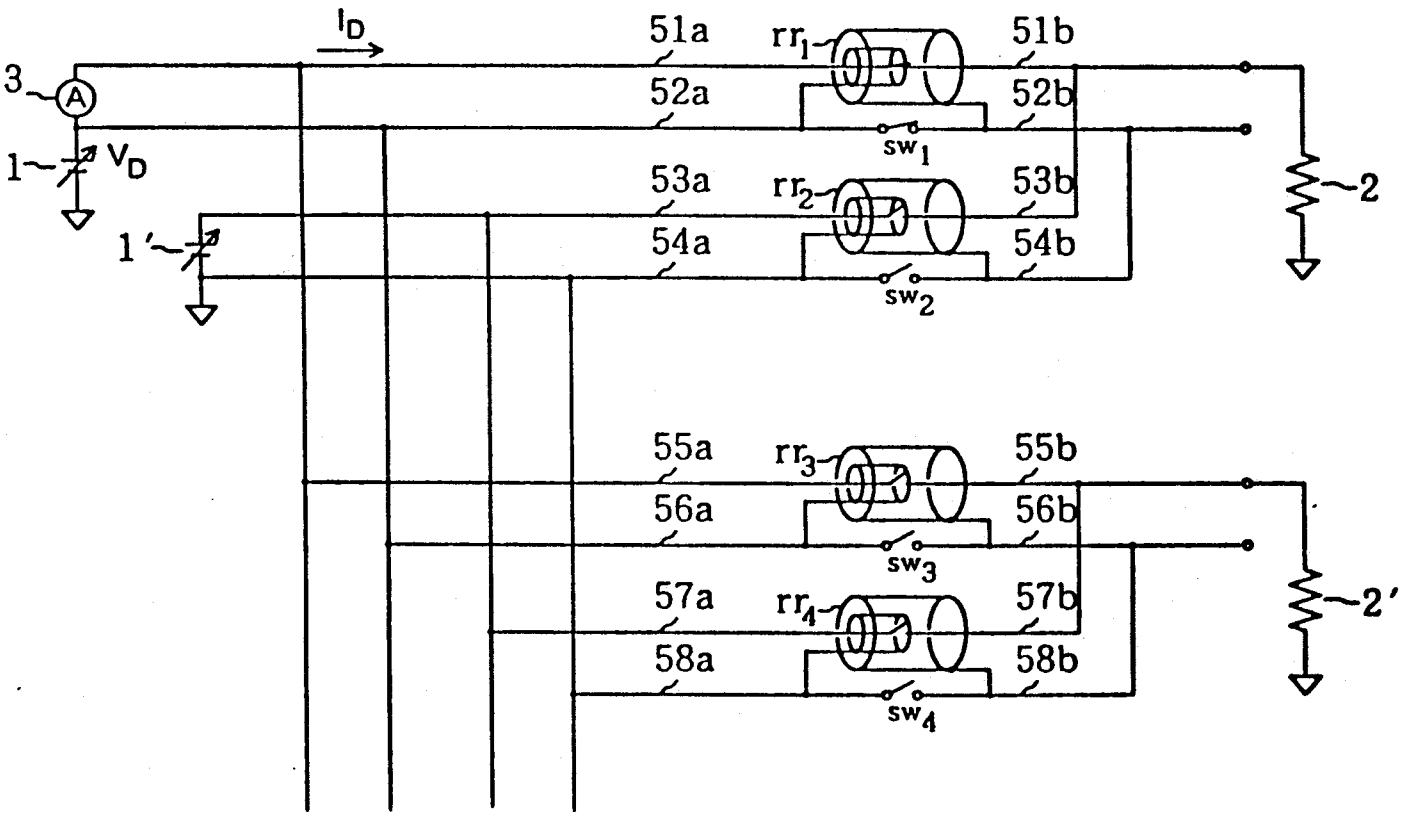
FIG. 7 is a schematic diagram of the switch matrix device according to the current invention which uses the reed relay as shown in FIG. 6.

FIG. 7 is a circuit diagram of an embodiment of the switch matrix device using the reed relay as shown in FIG. 6. The switch matrix device of this invention serves to perform switching operations for connection between plural measuring devices and plural DUTs. In order to simplify the description, FIG. 7 schematically shows a case where a combination of a D.C. power source 1 and a ammeter 3 is used as a measuring device, a D.C. power source 1' is used as another measuring device, and two resistors 2 and 2' are used as DUTs.

In FIG. 7, the reed relays $rr_1$ to $rr_4$ are provided with respective guard connecting switches $sw_1$ to $sw_4$. One end of each switch $sw_1$ to $sw_4$ (at the measuring device side in FIG. 7) is connected to the first guard pipe 15. The other end thereof (at the side of the DUTs 2 and 2') is connected to the second guard pipe 16. A positive terminal of the D.C. power source 1 with a negative grounded terminal is connected through the ammeter 3 and signal lines **51*a* and 55*a* to respective ends of the reed switches of the reed relays $rr_1$ and $rr_3$ (at the terminal b side as seen in FIG. 6). The same positive terminal is also connected through guard lines 52*a* and 56*a* to respective ends of the guard connecting switches $sw_1$ and $sw_3$ of the reed relays $rr_1$ and $rr_3$ (at the side connected to the first guard pipe 15). The potentials of the first guard pipes 15 at the points where they are connected to the switches $sw_1$ and $sw_3$ are equal to the output potential $V_D$ of the D.C. power source 1, so that the potentials of the first guard pipes 15 and the potentials of the second guard pipes 16 are kept at the same potential as the D.C. power source 1 when $sw_1$ or $sw_3$ is closed. The potentials of the first guard pipes 15 are used when the switch $sw_1$ is closed and the switch $sw_3$ is open. On the other hand, the potentials of the second guard pipes 16** are used when both $sw_1$ and $sw_3$ are closed.

A positive terminal of the D.C. power source 1' (having a grounded negative terminal) is connected through signal lines **53*a* and 57*a* to respective ends of the reed switches of the reed relays $rr_2$ and $rr_4$. The grounded terminal of the D.C. power source 1' is connected through guard lines 54*a* and 58*a* to respective ends of the guard connecting switches $sw_2$ and $sw_4$ of the reed relays $rr_2$ and $rr_4$ (at the side connected to the first guard pipe 15). The potential of each of the switches $sw_2$ and $sw_4$ at its guard line side is equal to ground potential so that the potentials of the first guard pipes 15 and the potentials of the second guard pipes 16 are kept at ground potential when the $sw_2$ or $sw_4$ is closed. The potentials of the first guard pipes 15 are used when the switch $sw_2$ is closed while the switch $sw_4$ is open. The potentials of the second guard pipes 16** are used when both $sw_2$ and $sw_4$ are closed.

The signal lines **51*b* and 53*b* of the reed relays $rr_1$ and $rr_2$ which are disposed at the DUT 2 side are connected to each other. The guard lines 52*b* and 54*b* are also connected to each other. The signal lines 55*b* and 57*b* of the reed relays $rr_3$ and $rr_4$ which are disposed at the DUT 2' side are connected to each other. The guard lines 56*b* and 58*b* are also connected to each other. In addition, a connecting point of the signal lines 51*b* and 53*b* is connected to the DUT 2. A connecting point of the signal lines 55*b* and 57*b* is connected to the DUT 2'; The other end of the DUTs 2 and 2'** is grounded.

An operation of the switch matrix device as shown in FIG. 7 will be described hereunder. For example, for measurement of a resistance value (high resistance) of the DUT 2, only the reed switch of the reed relay $rr_1$ and the guard connecting switch $sw_1$ are closed. Other reed switches $rr_2$ through $rr_4$ and other guard connecting switches $sw_2$ through $sw_4$ are open. In this switching state, a measuring system for the DUT 2 is constructed. That is, the voltage $V_D$ of the D.C. power source 1 is applied through the ammeter 3, the signal line **51*a*, the reed switch of the reed relay $rr_1$ and the signal line 51*b* to the DUT 2, whereby a measuring current $I_D$ flows through the above passageway and returns through the ground to the D.C. power source 1**.

In this case, the first and second guard pipes 15 and 16 of the reed relay $rr_1$ are kept at the potential $V_D$ of the power source 1 through the guard lines **52*a* and 52*b***, so that no leak current occurs in the reed relay $rr_1$.

In the reed relay $rr_2$, since the terminal potential of the signal line **53*b* of the reed switch is kept at the potential $V_D$ of the power source 1 and the first guard pipe 15 is grounded through the guard line 54*a*, a potential difference occurs between the terminal of the signal line 53*b* and the first guard pipe 15. However, since $rr_2$ is open, no surface of the insulating material serves as a passageway for a leak current between the terminal of the signal line 53*b* and the first guard pipe 15 and thus no significant leak current occurs between the signal line 53*b* and the first guard pipe 15. In addition, since the second guard pipe 16 is connected through the guard line 54*b* to the guard line 52*b*, which is kept at the potential $V_D$ of the power source 1, no leak current flows between the signal line 53*b* and the second guard pipe 16**.

However, when a passageway for a leak current exists on the surface of the insulating material 12 between the first guard pipe 15 and the second guard pipe 16 as indicated by an arrow of FIG. 6, there is a possibility that a leak current occurs. Although no leak current occurs between the signal lines **53*a* and 53*b* when the D.C. power sources 1 and 1' have the same voltages, it is possible that a leak current occurs between the signal lines 53***a* and 53*b* when the D.C. power sources 1 and 1' have different voltages. The majority of such leak current flows along the surface of the insulating material so that the leak current passageway between the signal lines 53*a* and 53*b* is positionally limited to the inner surface of the sealing glass of the reed switch. The inner surface of the sealing glass is in contact with an atmosphere within the sealed glass so that it is highly insulating. This insulating property of the inner surface is not deteriorated. Therefore, the leak current is remarkably slight and actually negligible.

It is also noted that the potential between the open terminals of the switch $sw_2$ is equal to $V_D$. Thus, a leak current may occur between the opened terminals of the switch $sw_2$. However, since the ammeter 3 is not disposed in a passageway for this leak current, the measuring system is not affected by this leak current. The measurement is performed with high accuracy. Since the same effects of the reed relay $rr_2$ as described above are obtained in the reed relays $rr_3$ and $rr_4$, there occurs no leak current which has an appreciable effect on the measuring system.

In the embodiment as shown in FIG. 6, the line-connecting direction of the reed relay is set such that the end of the first guard pipe 15 is directed to the measuring device side (to the D.C. power sources 1 and 1'). However, it may be set such that the end of the first guard pipe 15 is directed to the DUT 2 side.

While a specific embodiment is disclosed for the current invention, the present invention may be embodied in other specific forms without departing from the spirit or essential attributes thereof and accordingly, reference should be made to the appended claims, rather than to the foregoing specification, as indicating the scope of the invention. For example, this invention may adopt various types of reed relays such as a non-glass sealing type, a constantly-closing type, etc. The reed relay can have a reed switch sealed in glass for permanent opening.

According to this invention as described above, the following effects are obtained.

Figure 1:
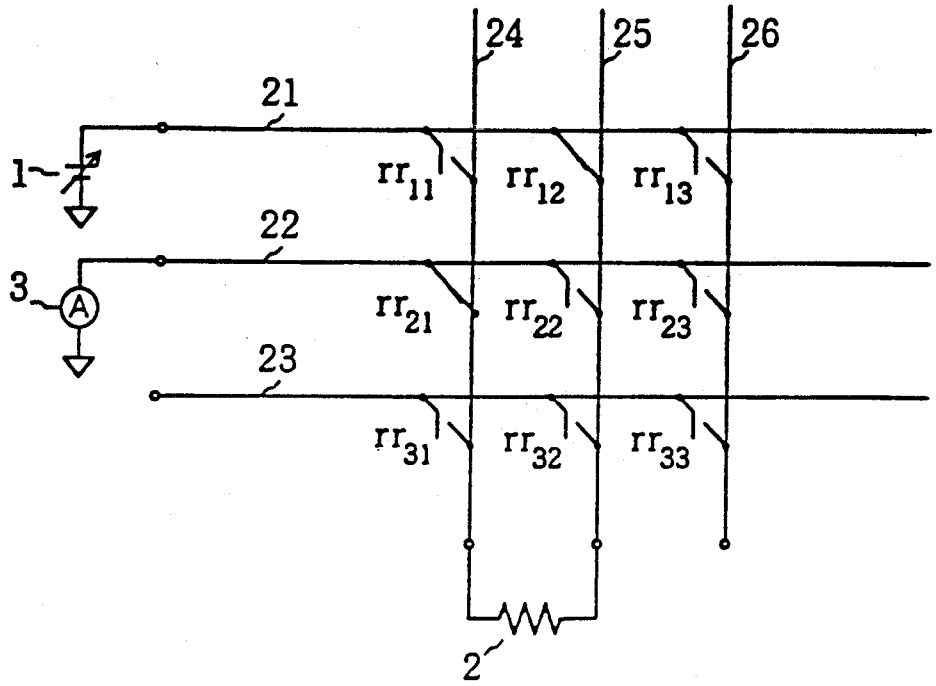
FIG. 1 is a schematic diagram of a conventional switch matrix device having no guard function.
Figure 2:
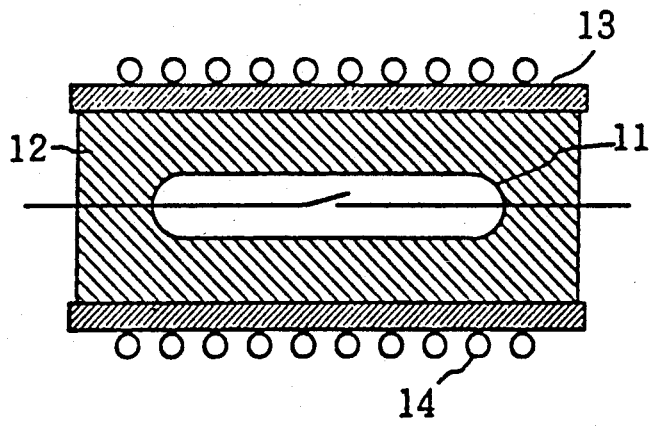
FIG. 2 is a sectional view of a conventional reed relay.
Figure 3:
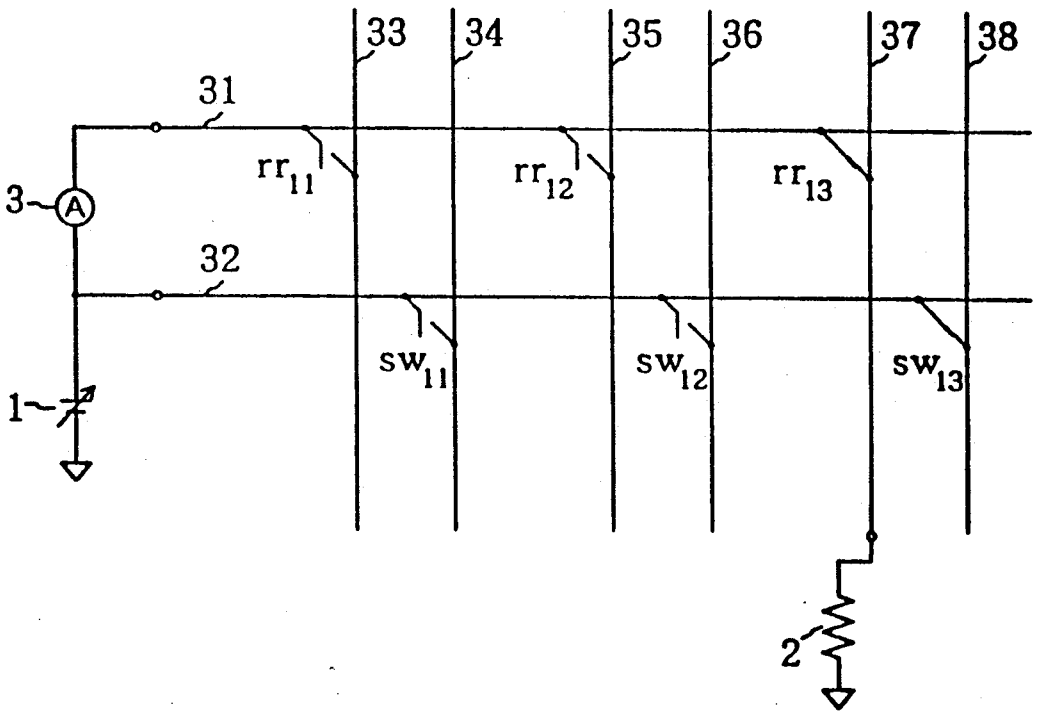
FIG. 3 is a schematic diagram of a conventional switch matrix device having the guard function.
Figure 4:
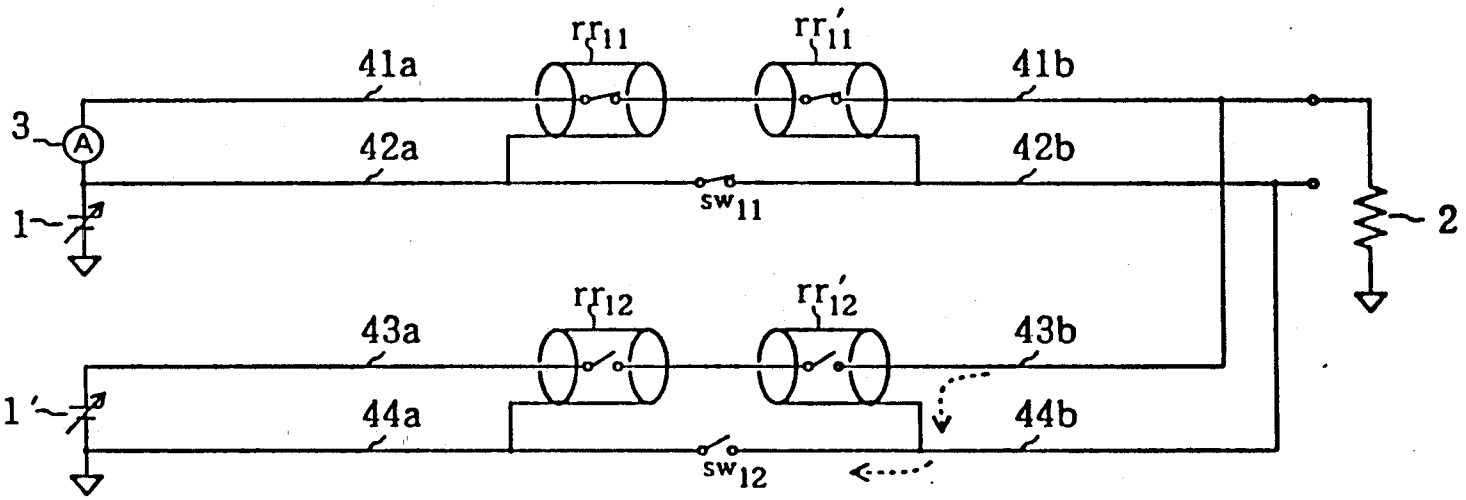
FIG. 4 is a schematic diagram of occurrence of a leak current in the switch matrix device having two voltage sources or measuring devices.
Figure 5:
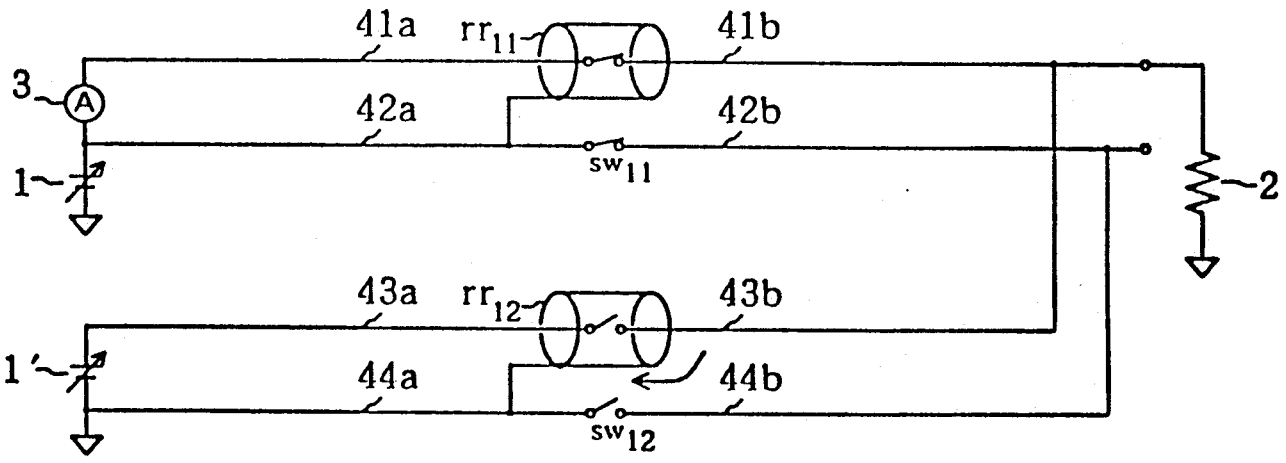
FIG. 5 is a schematic diagram of a conventional switch matrix device for preventing occurrence of the leak current in the device as shown in FIG. 4.

(1) It is possible to provide a reed relay and a switch matrix device which has low-manufacturing cost and high reliability because an increase in number of parts is not required. As shown in FIG. 5, the prior art requires twice as many relays to substantially eliminate the leak current as does the current invention. The current invention also has little residual resistance which is caused in a line connecting process.

(2) Since the guard pipes which are insulated from each other are provided in a region extending from one end of the reed relay to about the contact point and in a region extending from the other end of the reed relay to the contact point, the reed relay and the switch matrix device according to this invention have no leak current therein and are provided with high guard effect.

What is claimed is:

1. A reed relay comprising:

a reed switch having a contact point therein;

a first guard pipe covering a first region from one end of the reed switch to a position adjacent to the contact point of the reed switch; and a second guard pipe placed outside of the first guard pipe for covering a second region extending from the other end of the reed switch to at least one end of the first region, the second guard pipe being insulated from the first guard pipe.

2. A reed relay as claimed in claim 1, in combination with:

a guard connecting switch for performing a switching operation of connection between a measuring device and a device under test, the guard connecting switch having a first end connected to said first guard pipe, a second end connected to the second guard pipe, whereby a combination of the guard pipes and the connecting switch substantially eliminates any leak current in the reed relay.

3. A reed relay as claimed in claim 2 wherein the first and second guard pipes have a predetermined potential when the reed relay is closed.

4. A switch matrix system comprising:

a plurality of reed relay switches connected between one or more measuring devices and one or more devices under test for performing a switching operation, each of the relay switches having a contact point, a first guard pipe covering a first region from one end of the relay switch to a position adjacent to the contact point, and a second guard pipe placed outside the first guard pipe for covering a second region from the other end of the relay switch to at least one end of the first region, the second guard pipe being insulated from the first guard pipe; and a plurality of guard connecting switches connected between one or more measuring devices and one or more devices under test for performing a switching operation, each of the connecting switches corresponding to one of the relay switches for connecting one end of the connecting switch to the first guard pipe and the other end to the second guard pipe, whereby the first and second guard pipes are kept at a same voltage by closing the corresponding connecting switch when the corresponding relay switch is closed so as to substantially eliminate a leak current in the relay switch.

* * * * *